US009033338B2

(12) United States Patent
Wuthrich et al.

(10) Patent No.: US 9,033,338 B2
(45) Date of Patent: May 19, 2015

(54) STACKING MECHANISMS AND CASSETTES FOR DOCUMENTS

(71) Applicant: MEI, Inc., Malvern, PA (US)

(72) Inventors: Andreas Wuthrich, Crans-Montana (CH); Sebastien Menot, Thoiry (FR); Didier Szniaruk, Veyrier du Lac (FR); Alexandre Voeuk, Annecy le Vieux (FR)

(73) Assignee: MEI, INC., Malvern, PA (US)

( * ) Notice: Subject to any disclaimer, the term of this patent is extended or adjusted under 35 U.S.C. 154(b) by 0 days.

(21) Appl. No.: 14/457,447

(22) Filed: Aug. 12, 2014

(65) Prior Publication Data

US 2015/0054214 A1 Feb. 26, 2015

(30) Foreign Application Priority Data

Aug. 22, 2013 (EP) ..... 13181382

(51) Int. Cl.
*B65H 29/46* (2006.01)
*B65H 31/26* (2006.01)

(52) U.S. Cl.
CPC ..... *B65H 29/46* (2013.01); *B65H 31/26* (2013.01); *B65H 2301/342* (2013.01)

(58) Field of Classification Search
CPC ..... B65H 29/46; B65H 2301/3411; B65H 2301/342; B65H 2301/4212; B65H 31/26
USPC ..... 271/177, 180
See application file for complete search history.

(56) References Cited

U.S. PATENT DOCUMENTS

| | | | | |
|---|---|---|---|---|
| 5,564,691 | A * | 10/1996 | Hatamachi et al. | 271/178 |
| 8,100,395 | B2 * | 1/2012 | Afanasov et al. | 271/3.01 |
| 2003/0107166 | A1 * | 6/2003 | Cost et al. | 271/177 |

* cited by examiner

*Primary Examiner* — Michael McCullough

(57) ABSTRACT

A stacking mechanism for a cassette to store documents, a document cassette assembly comprising a stacking mechanism, and a method of stacking a document into a document cassette are described. The stacking mechanism can include a pusher plate that is adapted to push documents into the cassette. At least two shutter members of the stacking mechanism can be arranged to define a gap between each other. The shutter members can be movable. During a stacking operation, the shutter members can be moved so that the gap between the shutter members is enlarged. The documents can be pushed into the cassette through the enlarged gap by the pusher plate. Related apparatus, systems, techniques, and articles are also described.

20 Claims, 3 Drawing Sheets

STACKING MECHANISMS AND CASSETTES FOR DOCUMENTS

CROSS-REFERENCE TO RELATED APPLICATION

This application claims priority to European Application No. 13181382, filed Aug. 22, 2013, the entire contents of which is expressly incorporated by reference herein.

FIELD OF DISCLOSURE

This disclosure relates to stacking mechanisms for stacking documents into a document cassette and methods of stacking documents into a document cassette.

BACKGROUND

Documents of any kind are used to pay for goods. A rising number of goods, e.g. food, toys, medicine, tickets and so forth are available at vending machines. The customer can pay at these vending machines with documents, e.g. bills, banknotes or coupons. Further, document acceptors are also used in the gaming industries and in the banking sector. The received and accepted documents are typically stored within the machines in document cassettes. Stacking mechanisms are incorporated in the document acceptors to facilitate storage of the documents in the cassettes.

Various types of stackers are known. For example, commonly used piston-type stackers are described in US 2008/0128241 A1. Stackers with scissor mechanisms are described, for example, in EP 2 196 964 A1. It is generally desirable for the stacking mechanisms to have a simple construction and to be reliable in the operation of stacking documents. The more parts the respective stacker design has the more susceptible to failure is the stacking mechanism. Scissor type stacking mechanisms for example are built of a plurality of different parts and are therefore relatively expensive and complicated to assemble.

Another critical constraint of stacking mechanisms is the overall size of the mechanisms. This becomes particularly relevant when documents of different size shall be stacked within the same document cassette. On the one hand, the slot or gap through which the documents are pushed into the cassette has to be adapted to the smallest document to be stored so that the documents are safely retained in the cassette. On the other hand, the larger documents have to be folded during the insertion into the cassette and pushed relatively deep into the cassette to forward them entirely through the narrow gap adapted for the smallest documents to be inserted. This increases the required stroke of the, e.g., scissor or piston-type mechanism as well as the required force to fold the document and to push it deep into the cassette. An increased stroke in turn requires more space and an enhanced need of force for the stacking operation requires stronger and thus larger components for the stacking mechanism. Consequently, the overall size and weight of the stacking mechanism would be enlarged when trying to provide a stacking mechanism for different sizes of documents.

More generally, it would be helpful to have a stacking mechanism that has a robust and simple design on the one hand as well as a compact size and the ability to handle documents of a plurality of sizes on the other hand.

SUMMARY

The present subject matter relates to stacking mechanisms, document cassette assemblies, vending machines, methods for stacking a document into a document cassette, and the like.

For the purpose of this disclosure, the term document covers all kinds of valuable documents which include, but are not limited to, banknotes, bills, vouchers, certificates, coupons, checks, tokens, sheets, security papers, currency, tickets, or any other flexible planar item of the same nature.

A stacking mechanism for a cassette to store documents comprises a pusher plate adapted to push documents into the cassette and at least two shutter members that are arranged to define a gap between each other. The at least two shutter members of the stacking mechanism are movable.

According to one aspect of the present subject matter, the shutter members may be movable to enlarge the gap between each other. This means that the shutter members move away from each other to enlarge the gap and then move towards each other to reduce the gap again during a stacking operation. An enlargeable gap between the shutter members provides several advantages. For example, the gap for inserting the document may be designed small enough to safely secure the smallest documents to be stacked within a document cassette. Further, as the gap is enlarged during a stacking operation, the larger documents are more easily passed through the gap into the cassette. Additionally, the stroke of the stacking mechanism can be decreased compared to a stacking mechanism having a fixed gap size. Another advantage is that the forces for stacking the documents may be suppressed which in turn has positive effects for the design of the stacking mechanism components in terms of size, strength and forces to be applied and withstood.

In embodiments of the present subject matter, the shutter members and the pusher plate may be adapted to move concurrently during a stacking operation. Further, the pusher plate may be coupled to the shutter members. For example, the shutter members and the pusher plate may be kinematically coupled via a rack and pinion mechanism or by friction contact. Alternative coupling mechanisms may be applied as, for example, belts, chains or the like. Providing a link between the shutter members and the pusher plate may have the advantage that only one drive mechanism is necessary for operating the stacking mechanism. The pusher plate and the shutter members may be pivotally coupled to each other. The shutter members of the stacking mechanism may additionally or alternatively be adapted to move circularly upwards while the pusher plate moves linearly downwards during a stacking operation or the shutter members may be adapted to move circularly downwards while the pusher plate moves linearly upwards during a stacking operation.

According to another aspect, which may be combined with any of the above aspects, the pusher plate may further comprise at least two racks protruding perpendicular from a first surface of the pushed plate. The first surface is opposite a second surface of the pusher plate that contacts the documents during a stacking operation. Each of the racks may comprise teeth which may be directed laterally outwards with respect to the pusher plate. Further, each of the shutter members may comprise at least one coupling element. Each of the coupling elements may be adapted to couple to one of the racks on the pusher plate. Additionally, a first end of each of the coupling elements may be adapted to roll off the coupled rack during a stacking operation. In this regard, the coupling elements may have the shape of a segment of a circle to enable rolling off the rack. The first end of each of the coupling elements may comprise a pinion for engaging the teeth of the racks on the pusher plate. Such a design and kinematic connection between the shutter members and the pusher plate allows a simultaneous movement of the shutter members and the pusher plate, wherein the shutter members are circularly moved whereas the pusher plate is linearly moved. In embodiments, the shutter members and the respective coupling elements may be formed as a single integral part and/or the pusher plate and the racks may be formed as a single integral part.

According to another aspect of the present subject matter, the shutter members and the pusher plate may be adapted to move independently from each other. The shutter members and the pusher plate may, for example, be individually controlled, e.g., by a controller or central processing unit of the stacking mechanism or the machine in which the stacking mechanism is installed. An individual control of the pusher plate and the shutter members may allow a time shifted movement of these components which may be advantageous for specific applications, e.g., adapted to the types of documents to be stacked.

According to another aspect of the present subject matter, the shutter members may be adapted to move laterally outwards while the pusher plate moves linearly downwards or upwards during a stacking operation. For such a design, the stacking mechanism may also be adapted so that the pusher plate and the shutter members move either simultaneously or independently from each other. For the simultaneous movement, a respective mechanical link may be provided between the shutter members and the pusher plate. For example, the mechanical link may comprise a plurality of gears which are adapted to transform an upwards/downwards movement into a lateral movement. Alternative mechanisms may comprise strings, belts, chains or the like.

According to another aspect of the present subject matter, which may be combined with any of the above aspects, the shutter members may have an elongate shape and may be adapted to at least partially cover an opening of a document cassette. The shutter members may be arranged so that one or more documents pass through the gap between the shutter members during a stacking operation. The shutter members may further be arranged so that the pusher plate passes through the gap between the shutter members during a stacking operation.

According to another aspect, which may be combined with any of the above aspects, a width of the pusher plate may be larger than a width of the gap between the shutter members when the stacking mechanism is in an initial state. In this case, the gap between the shutter members is enlarged during a stacking operation so that the width of the gap becomes larger than the width of the pusher plate. This is advantageous as the pusher plate can be designed wider than conventional pusher plates, which ensures a safer stacking operation. The gap between the shutter members may be defined by respective facing edges of the shutter members running parallel to the longitudinal axis of the shutter members. In an initial state of the stacking mechanism, the width of the gap between the shutter members may be between 5 mm and 60 mm, between 15 mm and 55 mm, in particular between 25 mm and 50 mm.

According to further aspect, which may be combined with any of the above aspects, the shutter members of the stacking mechanism may define a document path. Respective surfaces of each of the shutter members may define the document path. In this respect, the shutter members may have a u-shape and the open ends of the u-shaped shutter members may be directed towards each other so as to define the document path.

According to another aspect, which may be combined with any of the above aspects, the stacking mechanism may further comprise a driving mechanism for operating the stacking mechanism. The driving mechanism may comprise independent actuators for the pusher plate and the shutter members. Alternatively, the driving mechanism may comprise one or more actuators for driving the shutter members and the pusher plate is driven via the shutter members. The driving mechanism may comprise at least one actuator that is coupled to the shutter members and adapted to rotationally or linearly move the shutter members. In embodiments, the driving mechanism may comprise at least one actuator for a first one of the shutter members and a second one of the shutter members is driven via a link between the first one and the second one of the shutter members. The link may, for example, comprise a shaft, a chain, a belt, a string, a cable, a wire and/or one or more gears. The driving mechanism may comprise at least one rotational motor. The rotational motor may, for example, be an electric motor.

According to a further aspect, which may be combined with any of the above aspects, portions of the shutter members defining the gap, e.g. the respective facing edges as defined above with respect to the width of the gap, may comprise chamfered tips. The tips may alternatively or additionally be rounded. Various radii may be formed. The geometry/kinematics and the form of the stacking mechanism, for example the tips of the shutter members and the movement of the shutter members in relation to the pusher plate and the stacked document, may be adapted to optimize the stacking operation and to avoid document jams or document shifts. After the document has been pushed into the cassette the pusher plate moves back out of the cassette and the shutter members are moved towards each other to return to their initial state. Thereby, the tips of the shutter members may slide on the top surface of the most recently inserted document. The geometry/kinematics of the stacking mechanism may therefore be adapted to keep the duration and force of the sliding contact minimal. Chamfered and/or rounded tips further help to keep the forces resulting from the sliding contact low. Alternatively or additionally, the shutter members may comprise or may be coated with a low friction material to reduce the friction between the shutter members and stacked banknotes. The low friction material may, for example, be Polytetrafluoroethylene (PTFE).

According to a further aspect, which may be combined with any of the above aspects, the shutter members may be arranged to define a banknote pathway that is capable of receiving banknotes of different sizes, in particular banknotes having a width between 60 mm and 85 mm.

According to another aspect, which may be combined with any of the above aspects, the stacking mechanism may further comprise drive wheels for forwarding the documents into the stacking mechanism to a position for stacking the document into a cassette, in particular, wherein forwarding the documents means bringing the document into the position for stacking the document into the cassette. The stacking mechanism may further comprise a drive wheel drive system for driving the drive wheels. The drive wheel drive system may be connected to the drive wheels via one or more of a shaft, a chain, a belt, a string, a cable, a wire and/or one or more gears. The drive wheel drive system may be independent of the driving mechanism for operating the stacking mechanism. In alternative embodiments, both the driving system and the driving mechanism may be driven by the same drive unit or motor. Further, the pusher plate may comprise cavities on lateral sides of the plate which are adapted to accommodate drive wheels.

According to a further aspect of the present subject matter, which may be combined with any of the above aspects, the stacking mechanism may further comprise a housing. The shutter members may be mounted within the housing. Further, the shutter members may be pivotably coupled to the housing or the shutter members may be coupled to the housing to allow a linear movement of the shutter members relative to the housing. Thereby, the housing provides on the one hand a protection for the stacking mechanism against any kind of contamination and impact of external forces on the mechanism's components (e.g., during assembly of the stacking mechanism and a cassette or insertion of the cassette and the stacking mechanism into a vending machine). On the other hand, the housing provides a frame for mounting and supporting various components of the stacking mechanism. For example, next to the shutter members, the drive wheels may also be supported by the housing in respective mountings.

According to another aspect of the present subject matter, which may be combined with any of the above aspects, the housing, the pusher plate and the shutter members may substantially be made of plastic. Alternatively, other suitable materials, like, e.g., any kind of metal, may also be used for the manufacturing of the stacking mechanism and its components.

According to a further aspect of the present subject matter, which may be combined with any of the above aspects, the stacking mechanism may comprise a controller that is adapted to control the movement of the shutter members and/or the pusher plate. The controller may further be adapted to control the drive wheels.

The above described design provides several advantages. For example, the entire stacking mechanism comprising any combination of features described above has a very simple design and can therefore be manufactured from a few parts only. The simple design also reduces the complexity of the assembly of the stacking mechanism. Therefore, the production of the stacking mechanism is very cost effective. Furthermore, only very little space is required to stack the documents, and in particular, documents of various sizes. Additionally, the risk of documents jams is very low. Further, the electric control of the stacking mechanism is very simple, as the start and endpoints of the movable parts (shutter members and/or pusher plate) of the mechanism allow hard stops in both directions. The compact design with the housing accommodating the movable parts makes the stacking mechanism robust against mechanical impacts like, e.g., unintentional drops or shocks. Further, the design and position of the document path, e.g., defined by the shutter members, allows the pusher plate to be arranged very close to the document. Thus, the documents can be immediately pinched when a stacking operation is initialized.

According to another aspect, a document cassette assembly for storing documents comprises a cassette housing adapted to store documents of a plurality of different sizes and a stacking mechanism according to any one of the above aspects. The stacking mechanism is attached to the cassette housing. In example embodiments, the stacking mechanism may be releasably attached to the cassette housing. One side of the cassette housing may comprise an opening and the stacking mechanism may be attached to the cassette housing so that the shutter members at least partially cover the opening. The document cassette assembly may further comprise a counter plate arranged within an inner volume of the cassette housing and adapted to support a stack of documents stored in the cassette. A spring may be mounted between a bottom of the cassette housing and the counter plate to bias the counter plate towards the stacking mechanism. The cassette assembly may further comprise a document validator connected to the stacking mechanism.

According to another aspect of the present subject matter, a vending machine comprises a stacker mechanism or a document cassette assembly as described above.

According to another aspect of the present subject matter, a method of stacking a document into a document cassette comprises the steps of:

First, a document is forwarded towards a stacking position along a document path. In particular, forwarding the document means bringing the document into the stacking position for being stacked. Then, the document is pushed from the stacking position into the document cassette through a gap defined between at least two shutter members by operating a pusher plate. During the stacking of the document, the shutter members are moved. The shutter members may be moved relative to each other so as to enlarge the gap between each other. This means that the shutter members move away from each other to enlarge the gap and then move towards each other to reduce the gap again during a stacking operation.

In embodiments of the present subject matter, the shutter members and the pusher plate may be moved concurrently during a stacking operation. In alternative embodiments, the shutter members and the pusher plate may be moved independently from each other.

The shutter members may move circularly upwards while the pusher plate moves linearly downwards during a stacking operation or the shutter members may move circularly downwards while the pusher plate moves linearly upwards during a stacking operation. Alternatively, the shutter members may move laterally outwards while the pusher plate moves linearly downwards or upwards during a stacking operation.

The method may further comprise the step of moving the shutter members to enlarge the gap between the shutter members during a stacking operation so that the width of the gap becomes larger than the width of the pusher plate.

The method of stacking a document may be performed with a stacking mechanism or a document cassette assembly as described above. The stacking mechanism or the document cassette assembly used for performing the method may therefore conform to and include any one of the above aspects disclosed in combination with the stacking mechanism and the document cassette assembly and provide any of the above described advantages.

These aspects, and how they are achieved, are explained in the detailed description in combination with the drawings.

DETAILED DESCRIPTION

Figure 1:
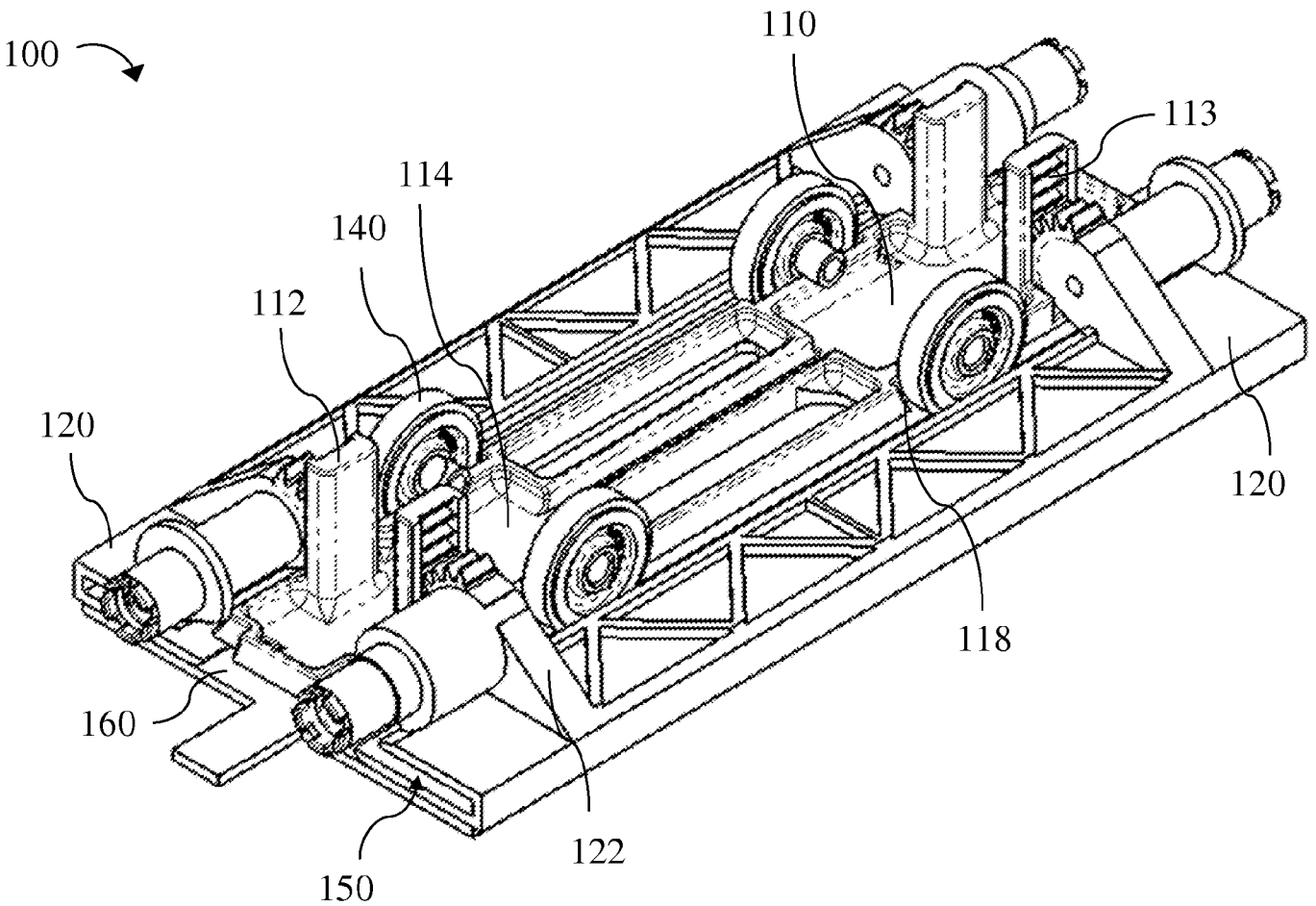
FIG. 1 illustrates a perspective view of a stacking mechanism according to one embodiment of the present subject matter.

FIG. 1 shows a stacking mechanism 100 for a cassette 200 to store documents. Such cassettes 200 are used, for example, in vending machines, gaming machines or cash handling machines. The shown stacking mechanism 100 comprises a pusher plate 110, which is adapted to push documents into the cassette 200. As shown in the embodiment of FIG. 1, two shutter members 120 are arranged about the pusher plate 110 and define a gap 130 between each other. The gap 130 between the shutter members 120 is defined by respective facing edges of the shutter members 120 running parallel to the longitudinal axis of the shutter members 120. In an initial state of the stacking mechanism 100, see FIG. 1 or FIG. 2, the width of the gap 130 between the shutter members 120 may be between 5 mm and 60 mm, between 15 mm and 55 mm, in particular between 25 mm and 50 mm. In other embodiments, the stacking mechanism 100 may comprise more than two shutter members, for example four shutter members, two on each side of gap 130. The two shutter members 120 of the stacking mechanism 100 are movable.

Figure 2:
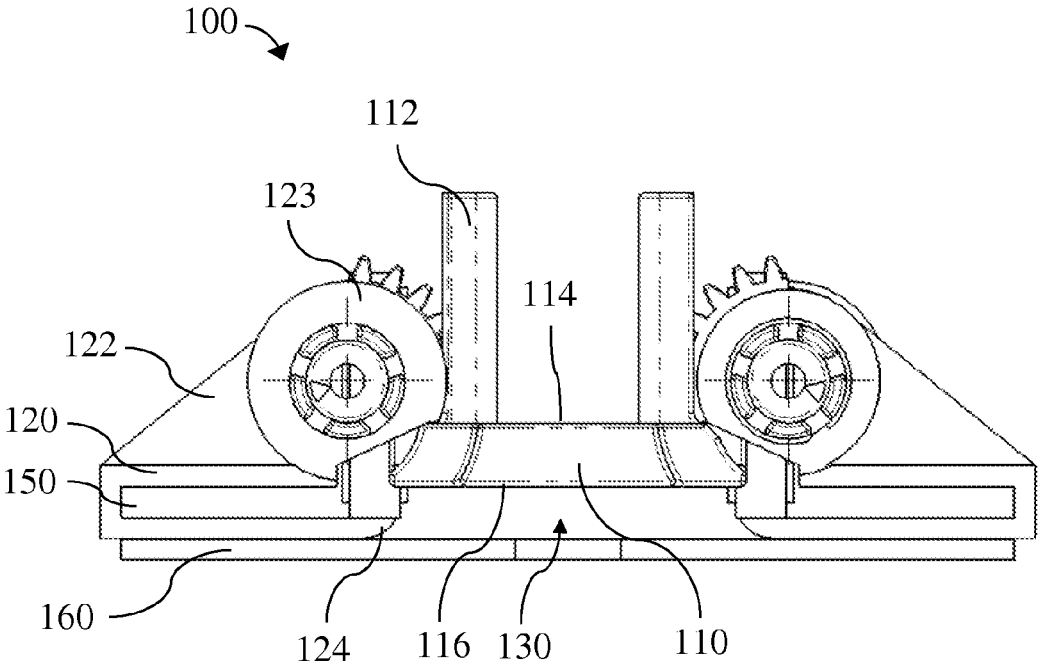
FIG. 2 illustrates a front view of a stacking mechanism in an initial state according to one embodiment of the present subject matter.
Figure 3:
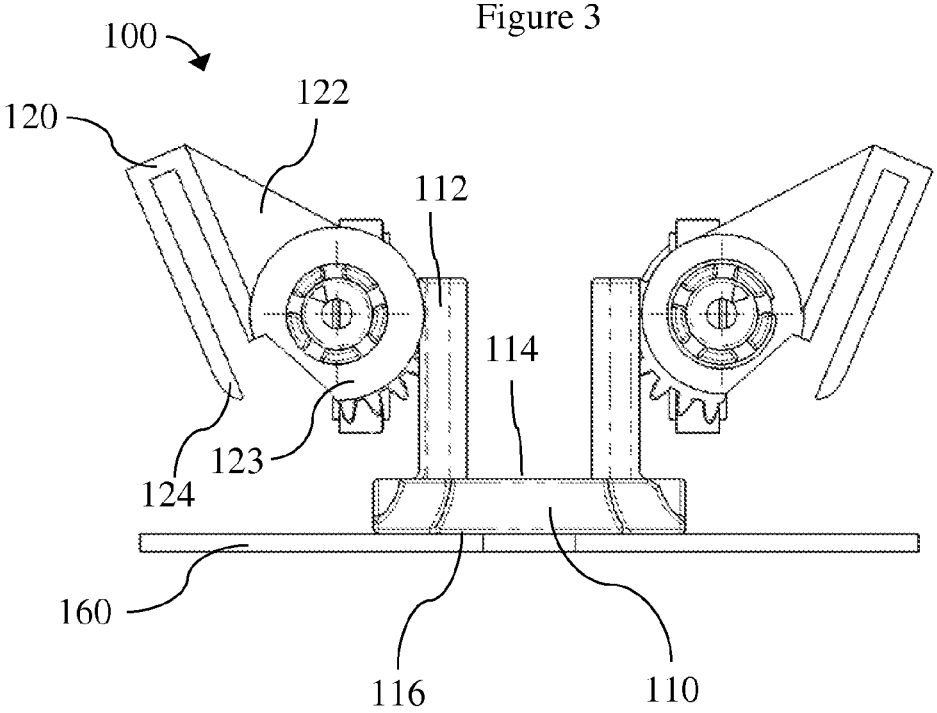
FIG. 3 illustrates a front view of a stacking mechanism during a stacking operation according to one embodiment of the present subject matter.

FIG. 2 and FIG. 3 show the stacking mechanism 100 at two different positions during a stacking operation. In FIG. 2, the stacking mechanism 100 is in an initial state and ready to receive a document to be stacked. The document is inserted into the stacking mechanism 100 via document path 150. FIG. 3 shows the stacking mechanism 100 during the stacking operation. The pusher plate 110 pushed the document (not shown) through the enlarged gap 130 into the cassette 200 and against counter plate 160.

As shown in FIG. 2 and FIG. 3 the shutter members 120 are movable with respect to each other to enlarge the gap 130 between each other. As the gap 130 between the shutter members is enlargeable, the gap 130 may be designed small enough to safely secure the smallest documents to be stacked within a document cassette 200. Further, as gap 130 becomes wider during the stacking operation, larger documents are more easily passed through gap 130 and into the cassette 200.

Figure 4:
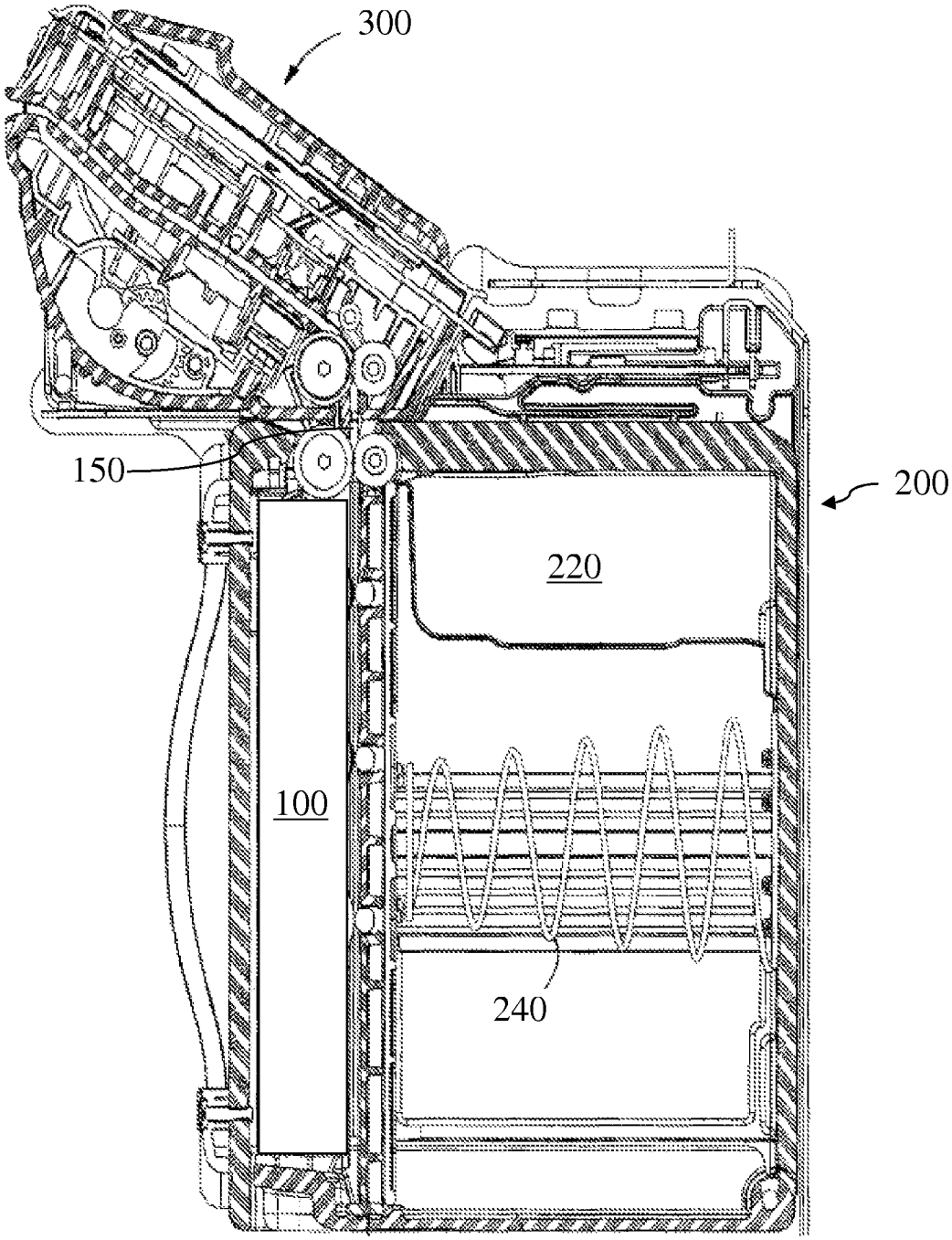
FIG. 4 illustrates a sectional view of a document cassette used in combination with a stacking mechanism according to one embodiment of the present subject matter.

FIG. 4 depicts a cassette 200 for storing documents comprising the stacking mechanism 100 (only shown as white block to illustrate the relative position of the stacking mechanism 100 in the cassette 200) and a document validator 300 attached to cassette 200. The document validator 300 is connected to the stacking mechanism 100 so that, e.g., after having been validated and/or denominated in the document validator 300, the documents can be transported from the document validator 300 to the stacking position in the stacking mechanism 100. The documents can then be pushed from the stacking position into cassette 200 by the stacking mechanism 100.

In the embodiment of the stacking mechanism 100 shown in FIGS. 1 to 3 the shutter members 120 and the pusher plate 110 are adapted to move concurrently during a stacking operation. To implement a simultaneous movement, the pusher plate 110 is coupled to the shutter members 120. As shown in FIG. 1 the shutter members 120 and the pusher plate 110 are kinematically coupled via a rack and pinion mechanism. Alternatively a friction contact may be implemented or other coupling mechanisms may be applied like, e.g., belts, chains or the like.

Providing a link between the shutter members 120 and the pusher plate 110 has the advantage that only one drive mechanism is necessary for operating the stacking mechanism. FIG. 1 shows the pusher plate 110 and the shutter members 120 pivotally coupled to each other. To establish the link between the pusher plate 110 and the shutter members 120, the pusher plate comprises at least two racks protruding perpendicular from a first surface 114 of the pushed plate 110. The embodiment depicted in FIGS. 1 to 3 comprises four racks 112. The first surface 114 of the pusher late 110 is opposite a second surface 116 that contacts the documents during a stacking operation. Each of the racks 112 comprises teeth 113 (see FIG. 1). The teeth 113 are directed laterally outwards with respect to the pusher plate 110 for coupling to the shutter members 120. Correspondingly, each of the shutter members 120 comprises two coupling elements 122. In other embodiments there may be a different number of racks 112 and respectively a corresponding number of coupling elements 122. For example an alternative stacking mechanism 100 may have only two racks 112 and one coupling element 122 per shutter member 120 or may have six or eight racks 112 and three or respectively four coupling elements 122 per shutter member 120. As can be seen on FIG. 1, each of the coupling elements 122 is adapted to couple to one of the racks 112 on the pusher plate 110 and can roll off the coupled rack 112 during a stacking operation (see FIGS. 2 and 3). To enable the shutter members 120 to roll off the racks 112 of the pusher plate 110, the coupling elements 122 have the shape of a segment of a circle. A safe contact between the coupling elements 122 of the shutter members 120 and the racks 112 of the pusher plate 110 is ensured in that the distal end of each of the coupling elements 122 comprises a pinion 123 (see FIGS. 2 and 3) for engaging the teeth 113 of the racks 112 on the pusher plate 110. The mechanical link of the shutter members 120 and the pusher plate 110 as described above allows a simultaneous movement of the shutter members 120 and the pusher plate 110, whereby the shutter members 120 are circularly moved whereas the pusher plate 110 is linearly moved. The shutter members 120 and the respective coupling elements 122 as well as the pusher plate 110 and the racks 112 respectively may be formed as single integral parts.

As shown in FIG. 1, the shutter members 120 have an elongate shape. The shape is adapted so that the shutter members 120 can, at least partially, cover an opening of document cassette 200. Further, the shutter members 120 are arranged so that one or more documents are pushed through the gap 130 between the shutter members 120 during a stacking operation.

Illustrated in FIG. 2, the width of the pusher plate 110 is larger than a width of the gap 130 between the shutter members 120 when the stacking mechanism 100 is in an initial state. When the gap 130 between the shutter members 120 is enlarged during a stacking operation, the width of the gap 130 becomes larger than the width of the pusher plate 110 and the pusher plate can push the document to be stacked through gap 130 and into the cassette 200. This is advantageous as the pusher plate 110 can be wider than conventional pusher plates of stacker mechanisms having a fixed gap size. The wider pusher plate 110 ensures a safe stacking operation.

The shutter members 120 of the stacking mechanism 100 define a document path 150 for receiving the documents to be stacked. In this regard, the shutter members 120 have a u-shape wherein the open ends of the u-shaped shutter members 120 are directed towards each other so as to define the document path 150 by respective inner surfaces of the u-shaped shutter members 120.

The stacking mechanism 100 further comprises a driving mechanism (not shown) for operating the stacking mechanism 100. The driving mechanism can be designed in different ways which are all combinable with the stacker mechanism 100 of FIGS. 1 to 3. For example, the driving mechanism may comprise one or more actuators for driving the shutter members 120 whereby the pusher plate 110 is driven via the kinematic connection between the shutter members 120 and the pusher plate 110. Alternatively, the driving mechanism may comprise at least one actuator for a first one of the shutter members 120 and a second one of the shutter members 120 is driven via a mechanical link between the first one and the second one of the shutter members 120. The link may, for example, comprise a shaft, a chain, a belt, a string, a cable, a wire and/or one or more gears. The driving mechanism may comprise at least one rotational motor. The rotational motor may, for example, be an electric motor.

As can be seen in FIGS. 2 and 3, portions of the shutter members 120 defining the gap 130 (the respective facing edges as mentioned above) comprise chamfered tips 124. The tips 124 may alternatively or additionally be rounded, wherein various radii may be formed. The geometry/kinematics and the form of the stacking mechanism 100, for example the tips 124 of the shutter members 120 and the movement of the shutter members 120 in relation to the pusher plate 110 and the stacked document (stacking operation described in more detail below), are adapted to optimize the stacking operation and to avoid document jams or document shifts. After the document has been pushed into the cassette 200, the pusher plate 110 moves back out of the cassette 200 and the shutter members 120 are moved towards each other to their position of the initial state (as seen in FIG. 2). Thereby, tips 124 of the shutter members 120 slide along the top surface of the most recently stacked document. The geometry design and the kinematics of the stacking mechanism are therefore adapted to keep the duration and force of the sliding contact between the shutter members 120 and the top surface of the document minimal. Chamfered and/or rounded tips 124 assist in keeping the forces that result from the sliding contact as low as possible. Alternatively or additionally, the shutter members 120 may comprise a low friction material or the shutter members 120 may be coated, for example at the tip portions of the shutter members, with the low friction material to reduce the friction between the shutter members and stacked banknotes. The low friction material may, for example, be Polytetrafluoroethylene (PTFE) more commonly known as Teflon® which is produced by DuPont.

The size of the stacking mechanism 100 can be adapted to the respective field of application. For example, the shutter members 120 may be arranged to define a banknote or document path 150 that is capable of receiving banknotes of different sizes, in particular banknotes having a width between 60 mm and 85 mm.

As shown on FIG. 1, the stacking mechanism 100 further comprises drive wheels 140 for forwarding the documents into the stacking mechanism 100 towards a position for stacking the document into the cassette 200. The drive wheels 140 are driven by a drive wheel drive system (not shown). The drive wheel drive system may be connected to the drive wheels 140 via a suitable mechanical link as for example a shaft, a chain, a belt, a string, a cable, a wire and/or one or more gears. The drive wheel drive system may be independent of the driving mechanism for operating the stacking mechanism. In alternative embodiments, the driving system and the driving mechanism may be designed so that they are driven by the same drive unit or motor. The pusher plate 110 comprises cavities 118 (see, FIG. 1) on lateral sides of the plate which are adapted to accommodate drive wheels 140.

A housing accommodates the stacking mechanism 100. The shutter members 120 are mounted within the housing. To enable the above described movement of the shutter members 120, the shutter members 120 are pivotably coupled to the housing. Thereby, the housing provides on the one hand a protection for the stacking mechanism 100 against any kind of contamination and impact of external forces on the mechanism's components (e.g., during assembly of the stacking mechanism and a cassette 200 or insertion of the cassette 200 and the stacking mechanism 100 into a vending machine). On the other hand, the housing provides a frame for mounting and supporting various components of the stacking mechanism 100. For example, besides the shutter members 120, also the drive wheels 140 are supported by the housing in respective mountings.

The housing, the pusher plate 110 and the shutter members 120 are preferably made substantially of plastic. Other suitable materials, like e.g. any kind of metal, may also be used for the manufacturing of the stacking mechanism 100 and its components.

For use as a subassembly within a vending machine or the like, the above described stacking mechanism 100 is combined with a cassette housing adapted to store documents of a plurality of different sizes to form a document cassette assembly for storing documents. The stacking mechanism 100 is attached to the cassette housing, wherein in some embodiments the stacking mechanism may be releasably connected to the cassette housing to allow replacement of one or the other component. One side of the cassette housing comprises an opening and the stacking mechanism 100 is attached to the cassette housing so that the shutter members 120 at least partially cover the opening. The document cassette assembly further comprises a counter plate 160 (see FIGS. 1 to 3) arranged within an inner volume 220 of the cassette housing and adapted to support a stack of documents stored in the cassette 200. A spring 240, e.g. a conical spring, is mounted between the cassette housing (such as a bottom or side wall) and the counter plate 160 to bias the counter plate 160 towards the stacking mechanism 100.

The stacking mechanism 100 or the document cassette assembly may be inserted into a vending machine, e.g., adjacent a validation unit of the vending machine, so that the inserted documents can travel along a document path of the vending machine, through the validation unit and into the stacking mechanism 100 to be stored with in the cassette 200.

Following, the operation of the stacking mechanism 100 is described in more detail.

Generally, stacking a document into a document cassette 200 according to the present subject matter comprises the steps of forwarding a document towards a stacking position along the document path 150 and pushing the document from the stacking position into a document cassette 200 through the gap 130 defined between the two shutter members 120 by operating the pusher plate 110. During the stacking of the document, the shutter members 120 are equally moved. As can be seen on FIGS. 2 and 3 the shutter members 120 are moved relative to each other so as to enlarge gap 130 between each other. FIG. 2 shows the stacking mechanism 100 in an initial position, ready to receive a document within the document path 150. In this state, gap 130 between the shutter members may even be narrower than the width of the pusher plate 110. FIG. 3 illustrates the stacking mechanism 100 in a second position during the stacking operation. The shutter members 120 turned circularly upwards while the pusher plate 110 concurrently moved linearly downwards and pushed the document (not shown) against counter plate 160 and into the cassette 200. The stacker mechanism 100 may also be oriented so that the shutter members move circularly downwards while the pusher plate moves linearly upwards during a stacking operation. As gap 130 between the shutter members 120 is enlarged, the pusher plate 110 can now freely pass through gap 130 to push the document to be stacked into the cassette 200. The counter plate 160 is biased towards the stacking mechanism 100, e.g., via a spring 240 mounted within the document cassette 200, to provide a clamping force that ensures that the document to be stacked does not slide across the counter plate 160 or the documents already stacked on the counter plate 160. When the stacking mechanism 100 is returned from the stacking position of FIG. 3 to the initial position of FIG. 2, the pusher plate 110 moves upwards and the shutter members 120 turn downwards inwards and narrow the gap 130 between the shutter members 120. The chamfered tips 124 as well as the (surface) material of the shutter members 120 guarantee that the shutter members 120 slide smoothly along the surface of the most recently stacked document when the pusher plate 110 is not any more in contact with the document. As seen on FIGS. 2 and 3, the geometry/kinematics of the stacking mechanism 100 is adapted to keep the duration and force of the sliding contact between the shutter members 120 and the document minimal. When the stacking mechanism 100 has returned to its initial state, the gap 130 is small enough so that the shutter members 120 reliably secure the stacked documents within the cassette 200.

The entire stacking operation, including the movement of the pusher plate 110, the shutter members 120 and/or the drive wheels 140, can be controlled, for example, by an independent controller for the stacking mechanism 100 or by a central processing unit of the, e.g., vending machine in which the stacking mechanism 100 is installed. The control of the actuator or motor for the driving mechanism may be handled by a relative simple electronic controller as the movement of the shutter members 120 and the pusher plate 110 is limited by hard stops in both directions. The drive wheels 140 and the drive wheel drive system for forwarding the documents into the stacking mechanism 100 are controlled individually from the stacking operation but may also be controlled by a common central processing unit.

In a further embodiment of the present subject matter, the shutter members and the pusher plate are adapted to move independently from each other. In this case, the shutter members and the pusher plate may, for example, be individually controlled, e.g., by the above mentioned controller or central processing unit of the stacking mechanism or the machine in which the stacking mechanism is installed. An individual control of the pusher plate and the shutter members can provide a time shifted movement of these components which may be advantageous for some applications, e.g., for specific types of documents to be stacked. For such a design, the shutter members and the pusher plate are either connected via a disengageable link or no mechanical link at all is provided between these components. Further, the driving mechanism may comprise independent actuators for the pusher plate and the shutter members to enable the desired independent control.

In an alternative embodiment of the present subject matter, the shutter members are adapted to move laterally outwards while the pusher plate moves linearly downwards or upwards during a stacking operation. For such a design, the drive mechanism has to be adapted for linear movement of the shutter members and the shutter members are coupled to the housing so as to allow linear movement of the shutter members relative to the housing. It is nevertheless possible that the stacking mechanism is adapted so that the pusher plate and the shutter members move either simultaneously or independently from each other. The simultaneous movement can be realized by a respective mechanical link provided between the shutter members and the pusher plate. For example, the mechanical link may comprise a plurality of gears which are adapted to transform an upwards/downwards movement into a lateral movement. Alternative mechanisms for transferring the movement between the shutter members and the pusher plate may comprise strings, belts, chains or the like. Such a design of the stacking mechanism would require less space in the vertical dimension. However, the lateral expansion during the stacking operation would be enlarged compared to the above embodiment.

A number of embodiments of the current subject matter have been described. Nevertheless, it will be understood that various modifications may be made without departing from the scope of the invention.

Although the present current subject matter is defined in the attached claims, it is to be understood that the current subject matter can alternatively also be defined in accordance with the following example embodiments:

In an aspect, a stacking mechanism (100) for a cassette to store documents can include a pusher plate (110) adapted to push documents into the cassette. At least two shutter members (120) can be arranged to define a gap (130) between each other. The shutter members (120) can be movable.

One or more of the following features can be included in any feasible combination. For example, the shutter members (120) can be movable to enlarge the gap (130) between each other. The shutter members (120) and the pusher plate (110) can be adapted to move concurrently during a stacking operation. The pusher plate (110) can be coupled to the shutter members (120). The shutter members (120) and the pusher plate (110) can be kinematically coupled via a rack and pinion mechanism or by friction contact. The pusher plate (110) and the shutter members (120) can be pivotally coupled to each other. The shutter members (120) can be adapted to move circularly upwards while the pusher plate (110) moves linearly downwards during a stacking operation. The shutter members (120) can be adapted to move circularly downwards while the pusher plate (110) moves linearly upwards during a stacking operation.

The pusher plate (110) can further include at least two racks (112) protruding perpendicular from a first surface (114) of the pusher plate (110). A second surface (116) of the pusher plate can contact the documents during a stacking operation and the first surface (114) can be opposite the second surface (116). Each of the racks (112) can include teeth (113) and the teeth (113) can be directed laterally outwardly with respect to the pusher plate (110). Each of the shutter members (120) can include at least one coupling element (122), and each coupling element (122) can be adapted to couple to one of the racks (112) on the pusher plate (110). A first end of each of the coupling elements (122) can be adapted to roll off the coupled rack (112) during a stacking operation. The first end of each of the coupling elements (122) can include a pinion (123) for engaging the racks (112) on the pusher plate (110). Each of the shutter members (120) and the respective coupling elements (122) can be formed as a single integral part and/or the pusher plate (110) and the racks (112) can be formed as a single integral part.

The shutter members (120) and the pusher plate (110) can be adapted to move independently from each other. The shutter members (120) can be adapted to move laterally outwards while the pusher plate (110) moves linearly downwards or upwards during a stacking operation. Shutter members (120) can have an elongate shape and can be adapted to at least partially cover an opening of a document cassette. The shutter members (120) can be arranged so that one or more documents pass through the gap (130) between the shutter members during a stacking operation. The shutter members (120) can be arranged so that the pusher plate (110) passes through the gap (130) between the shutter members (120) during a stacking operation. A width of the pusher plate (110) can be larger than a width of the gap (130) between the shutter members (120) when the stacking mechanism is in an initial state. The gap (130) between the shutter members (120) can be enlarged during a stacking operation so that the width of the gap (130) becomes larger than the width of the pusher plate (110). The stacking mechanism can further include drive wheels (140) for forwarding the documents into the stacking mechanism. The shutter members (120) can define a document path (150). Respective surfaces of each of the shutter members (120) can define the document path (150). The shutter members (120) can have a u-shape and the open ends of the u-shaped shutter members (120) can be directed towards each other so as to define the document path (150).

The stacking mechanism can further include a driving mechanism for operating the stacking mechanism. The driving mechanism can include independent actuators for the pusher plate (110) and the shutter members (120). The driving mechanism can include one or more actuators for the shutter members (120) and the pusher plate (110) can be driven via the shutter members (120). The driving mechanism can include at least one actuator that is coupled to the shutter members (120) and adapted to rotationally or linearly move the shutter members (120). The driving mechanism can include at least one actuator for a first one of the shutter members (120) and a second one of the shutter members (120) can be driven via a link between the first one and the second one of the shutter members (120). The link can include a shaft, a chain, a belt, a string, a cable, a wire and/or one or more gears. The driving mechanism can include at least one rotational motor. The rotational motor can be an electric motor.

Portions of the shutter members (120) defining the gap can include chamfered tips (124). The shutter members (120) can include or can be coated with a low friction material to reduce the friction between the shutter members (120) and stacked banknotes. The low friction material can be Polytetrafluoroethylene (PTFE). The shutter members (120) can be arranged to define a banknote or document path (150) capable of receiving banknotes of different sizes, in particular banknotes having a width between 60 mm and 85 mm.

The stacking mechanism can further include a housing. The shutter members (120) can be mounted within the housing. The shutter members (120) can be pivotably coupled to the housing and/or the shutter members (120) can be coupled to the housing to allow a linear movement of the shutter members (120) relative to the housing. The housing can further include mountings adapted to support drive wheels (140). A drive wheel drive system can be included for driving the drive wheels (140). The drive wheel drive system can be connected to the drive wheels (140) via one or more of a shaft, a chain, a belt, a string, a cable, a wire and/or a gear. The pusher plate (110) can include cavities (118) on lateral sides of the pusher plate (110) adapted to accommodate drive wheels (140). The pusher plate (110) and the shutter members (120) can be substantially made of plastic. A controller can be included and adapted to control the movement of the shutter members (120) and/or the pusher plate (110).

A document cassette assembly to store documents can include a cassette housing adapted to store documents of a plurality of different sizes; and a stacking mechanism (100) attached to the cassette housing. The stacking mechanism (100) can be releasably attached to the cassette housing. One side of the cassette housing can include an opening and the stacking mechanism (100) can be attached to the cassette housing so that the shutter members (120) at least partially cover the opening. A counter plate (160) arranged within an inner volume of the cassette housing can be included and adapted to support a stack of documents stored in the cassette. The document cassette assembly can further include a spring mounted between a bottom of the cassette housing and the counter plate (160) to bias the counter plate (160) towards the stacking mechanism (100). A document validator connected to the stacking mechanism can be included. A vending machine can include a stacker mechanism or a document cassette assembly.

In another aspect, stacking a document into a document cassette can include the steps of: forwarding the document towards a stacking position along a document path; and pushing the document from the stacking position into the document cassette through a gap defined between at least two shutter members (120) by operating a pusher plate (110). The shutter members (120) can be moved during the stacking of the document.

One or more of the following features can be included in any feasible combination. The shutter members (120) can be moved to enlarge the gap between each other. The shutter members (120) and the pusher plate can move concurrently during a stacking operation. The pusher plate (110) can be coupled to the shutter members (120). The shutter members (120) and the pusher plate (110) can be kinematically coupled via a rack and pinion mechanism or by friction contact. The pusher plate (110) and the shutter members (120) can be pivotably coupled to each other. The shutter members (120) can move circularly upwards while the pusher plate moves linearly downwards during a stacking operation or the shutter members (120) can move circularly downwards while the pusher plate (110) moves linearly upwards during a stacking operation.

The pusher plate can further include at least two racks protruding perpendicular from a first surface of the pusher plate (110). A second surface of the pusher plate can contact the documents during a stacking operation and the first surface can be opposite the second surface. Each of the racks can include teeth and the teeth can be directed laterally outwardly with respect to the pusher plate (110). Each of the shutter members (120) can include at least one coupling element each adapted to couple to one of the racks on the pusher plate (110). A first end of each of the coupling elements can roll off the coupled rack during a stacking operation. The first end of each of the coupling elements can include a pinion for engaging the racks on the pusher plate (110). The shutter members (120) and the pusher plate (110) can move independently from each other. The shutter members (120) can move laterally outwards while the pusher plate (110) moves linearly downwards or upwards during a stacking operation. Shutter members (120) can have an elongate shape and are adapted to at least partially cover an opening of a document cassette.

A width of the pusher plate (110) can be larger than a width of the gap between the shutter members (120) when the stacking mechanism is in an initial state. The shutter members (120) can be moved to enlarge the gap between the shutter members (120) during a stacking operation so that the width of the gap becomes larger than the width of the pusher plate (110). The document can be forwarded by drive wheels (140) arranged within the stacking mechanism. The document path can be defined by the shutter members (120). Respective surfaces of each of the shutter members (120) can define the document path. The shutter members (120) can have a u-shape and the open ends of the u-shaped shutter members can be directed towards each other so as to define the document path. The stacking mechanism can be operated by a driving mechanism. The driving mechanism can include independent actuators for the pusher plate (110) and the shutter members (120). The driving mechanism can include one or more actuators for the shutter members (120) and the pusher plate (110) can be driven via the shutter members (120). The driving mechanism can include at least one actuator that is coupled to the shutter members (120) and rotationally or linearly moves the shutter members (120). The driving mechanism can include at least one actuator for a first one of the shutter members (120) and a second one of the shutter members (120) can be driven via a link between the first one and the second one of the shutter members. The link can include a shaft, a chain, a belt, a string, a cable, a wire and/or one or more gears. The driving mechanism can include at least one rotational motor. The rotational motor can be an electric motor.

Portions of the shutter members (120) defining the gap can include chamfered tips. The shutter members can include or can be coated with a low friction material to reduce the friction between the shutter members (120) and stacked banknotes. The low friction material can be Polytetrafluoroethylene (PTFE) (Teflon®). The shutter members (120) can be arranged to define a banknote pathway capable of receiving banknotes of different sizes, in particular banknotes having a width between 60 mm and 85 mm. A housing accommodates at least the shutter members. The shutter members (120) can be mounted within the housing. The shutter members (120) can be pivotably coupled to the housing and/or the shutter members (120) can be coupled to the housing to allow a linear movement of the shutter members relative to the housing. The housing can further include mountings adapted to support drive wheels (140).

A drive wheel drive system can drive the drive wheels (140). The drive wheel drive system can be connected to the drive wheels (140) via one or more of a shaft, a chain, a belt, a string, a cable, a wire and/or a gear. The pusher plate (110) can include cavities on the lateral sides of the plate adapted to accommodate drive wheels (140). The pusher plate (110) and the shutter members (120) can be substantially made of plastic. A controller can control the movement of the shutter members (120) and/or the pusher plate (110).

Although a few variations have been described in detail above, other modifications are possible. For example, the implementations described above can be directed to various combinations and subcombinations of the disclosed features and/or combinations and subcombinations of several further features disclosed above. In addition, the logic flows described herein do not require the particular order shown, or sequential order, to achieve desirable results. Other embodiments may be within the scope of the following claims.

What is claimed is:

1. A stacking mechanism for a cassette to store documents, the stacking mechanism comprising:

a pusher plate adapted to push documents into the cassette, the pusher plate comprising at least two racks protruding perpendicular from a first surface of the pusher plate; and at least two shutter members arranged to define a gap between each other, wherein the at least two shutter members are movable and each of the at least two shutter members comprises at least one coupling element, and each coupling element is adapted to couple to one of the at least two racks on the pusher plate.

2. The stacking mechanism according to claim 1, wherein the at least two shutter members are movable to enlarge the gap between each other.

3. The stacking mechanism according to claim 1, wherein the at least two shutter members and the pusher plate are adapted to move concurrently during a stacking operation.

4. The stacking mechanism according to claim 1, wherein the pusher plate is coupled to the at least two shutter members.

5. The stacking mechanism according to claim 4, wherein the at least two shutter members and the pusher plate are kinematically coupled via a rack and pinion mechanism.

6. The stacking mechanism according to claim 4, wherein the at least two shutter members and the pusher plate are kinematically coupled by friction contact.

7. The stacking mechanism according to claim 4, wherein the at least two shutter members and the pusher plate are pivotally coupled to each other.

8. The stacking mechanism according to claim 1, wherein the at least two shutter members are adapted to move circularly upwards while the pusher plate moves linearly downwards during a stacking operation, or wherein the at least two shutter members are adapted to move circularly downwards while the pusher plate moves linearly upwards during the stacking operation.

9. The stacking mechanism according to claim 1, wherein the at least two shutter members and the pusher plate are adapted to move independently from each other.

10. The stacking mechanism according to claim 1, wherein the at least two shutter members are adapted to move laterally outwards while the pusher plate moves linearly downwards or upwards during a stacking operation.

11. The stacking mechanism according to claim 1, wherein a width of the pusher plate is larger than a width of the gap between the at least two shutter members when the stacking mechanism is in an initial state and wherein the gap between the at least two shutter members is enlarged during a stacking operation so that the width of the gap becomes larger than the width of the pusher plate.

12. The stacking mechanism according to claim 1, wherein the at least two shutter members have a u-shape with open ends and wherein the open ends are directed towards each other so as to define a document path.

13. The stacking mechanism according to claim 1, wherein portions of the at least two shutter members defining the gap comprise chamfered tips, and wherein the at least two shutter members comprise or are coated with a low friction material to reduce a friction between the at least two shutter members and stacked banknotes.

14. The stacking mechanism according to claim 1 further comprising a housing and wherein the at least two shutter members are mounted within the housing.

15. The stacking mechanism according to claim 1 further comprising a controller adapted to control movement of the at least two shutter members and the pusher plate.

16. A document cassette assembly to store documents comprising:

a cassette housing adapted to store documents of a plurality of different sizes; and a stacking mechanism attached to the cassette housing, the stacking mechanism comprising:

a pusher plate adapted to push documents, the pusher plate comprising at least two racks protruding perpendicular from a first surface of the pusher plate, and at least two shutter members arranged to define a gap between each other, wherein the shutter members are movable and each of the at least two shutter members comprises at least one coupling element, and each coupling element is adapted to couple to one of the at least two racks on the pusher plate.

17. The document cassette assembly according to claim 16 further comprising a counter plate arranged within an inner volume of the cassette housing and adapted to support a stack of documents stored in the document cassette assembly; and wherein a spring is mounted between a bottom of the cassette housing and the counter plate to bias the counter plate towards the stacking mechanism.

18. The document cassette assembly according to claim 16 further comprising a document validator connected to the stacking mechanism.

19. The stacking mechanism according to claim 16, wherein the at least two shutter members and the pusher plate are adapted to move independently from each other.

20. A method of stacking a document into a document cassette, the method comprising:

forwarding the document towards a stacking position along a document path;

pushing the document from the stacking position into the document cassette through a gap defined between at least two shutter members by operating a pusher plate, the pusher plate comprising at least two racks protruding perpendicular from a first surface of the pusher plate, wherein the at least two shutter members are moved during the stacking of the document and each of the at least two shutter members comprises at least one coupling element, and each coupling element is adapted to couple to one of the at least two racks on the pusher plate.

* * * * *